US005733109A

United States Patent [19]

Sundberg

[11] Patent Number: 5,733,109

[45] Date of Patent: Mar. 31, 1998

[54] VARIABLE DISPLACEMENT VANE PUMP WITH REGULATED VANE LOADING

[75] Inventor: Jack G. Sundberg, Meriden, Conn.

[73] Assignee: Coltec Industries Inc., New York, N.Y.

[21] Appl. No.: 501,758

[22] Filed: Jul. 12, 1995

[51] Int. Cl.[6] ..... F04C 2/344

[52] U.S. Cl. ..... 418/30; 418/268

[58] Field of Search ..... 418/267, 268, 418/30

[56] References Cited

U.S. PATENT DOCUMENTS

| | | | |
|---|---|---|---|
| 2,545,238 | 3/1951 | MacMillin et al. | 418/268 |
| 3,102,494 | 9/1963 | Adams | 418/268 |
| 3,407,742 | 10/1968 | Mitchell et al. | 418/268 |
| 3,451,346 | 6/1969 | Pettibone | 418/268 |
| 4,354,809 | 10/1982 | Sundberg | 418/268 |

FOREIGN PATENT DOCUMENTS

| | | | |
|---|---|---|---|
| 463807 | 12/1971 | U.S.S.R. | 418/268 |

*Primary Examiner*—John J. Vrablik
*Attorney, Agent, or Firm*—Howard S. Reiter

[57] ABSTRACT

A novel single acting variable displacement vane pump (VDVP) incorporating novel vanes and undervane venting which produce selective regulated pressure-loading of the vanes against the cam surface and more positive tracking in the incoming seal arc and the outgoing or discharge seal arc of the pump rather than uniform pressure balancing of the vanes throughout the 360° cam chamber. The vanes incorporated into the present pumps preferably are sectional two-piece vane assemblies comprising an upper vane section which slidably supports a lower vane section and incorporates a fluid pressurizable cavity between said vane sections which, when pressurized, forces the vane sections in opposite radial directions, and which enables the vane sections to come together and integrate when the cavity is depressurized. The vane cavity is open to the fluid pressure on one side of the vanes while the undervane area of the vane slots, below the vanes, is open to the fluid pressure one the opposite side of the vanes. Thus, in the inlet seal arc area of the pump the vane cavity becomes pressurized to force the vane sections apart and force the upper vane section against the cam surface, and in the outlet or discharge seal arc area of the pump the vane cavity becomes depressurized and the undervane area of each vane slot becomes pressurized, to force the vane sections together and force the upper vane section against the cam surface.

4 Claims, 2 Drawing Sheets

VARIABLE DISPLACEMENT VANE PUMP WITH REGULATED VANE LOADING

BACKGROUND OF THE INVENTION

1. Field of the Invention

The present invention relates to single acting, variable displacement fluid pressure vane pumps, such as fuel and hydraulic control pumps for aircraft use.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and systems have been developed in order to overcome some of the deficiencies of gear pumps, and reference is made to the following U.S. Patents for their disclosures of several such pumps and systems: U.S. Pat. Nos. 4,247,263; 4,354,809; 4,529,361 and 4,711,619.

Vane pumps comprise a rotor element machined with axial slots supporting radially-movable vane elements, mounted within a cam member having fluid inlet and outlet ports in the faces of the cam member through which the fluid is fed radially to the inlet areas or buckets of the rotor surface for compression and discharge from the outlet areas or buckets of the rotor surface and axially in both directions as pressurized fluid.

Vane pumps that are required to operate at high speeds and pressures preferably employ hydrostatically (pressure) balanced vanes for maintaining vane contact with the interior cam surface in seal arcs and for minimizing frictional wear. Such pumps may also include radially-rounded vane tips to reduce vane-to-cam surface stresses. Examples of vane pumps having pressure-balanced vanes which are also adapted to provide undervane pumping may be found in U.S. Pat. Nos. 4,354,809 and 4,529,361. The latter patent discloses a vane pump incorporating undervane pumping wherein the vanes are hydraulically balanced in not only the inlet and discharge areas but also in the seal arcs whereby the resultant pressure forces on a vane cannot displace it from engagement with the interior cam surface in seal arc areas. Reference is also made to copending application, Ser. No. 08/114,253 filed Aug. 30, 1993, the disclosure of which is hereby incorporated herein.

The vane pumps of U.S. Pat. No. 4,529,361 are fixed displacement, double action pumps with opposed inlet arcs and opposed discharge arcs. The rotor member thereof comprises radial spokes fitted with channel-shaped vanes. Such pumps are of limited utility and are relatively complex and susceptible to wear compared to variable displacement, single-acting vane pumps.

In conventional variable displacement, single-acting vane pumps it is known to provide means for balancing the pressures under the vanes and over the vanes to maintain the vane tips in continuous contact with the cam surface during operation of the pump. As the rotor turns, the vanes are moved through a low pressure inlet arc of the cam chamber, through an incoming seal arc in which the leading edge size of the vane is exposed to increasing pressure while the trailing edge side of the vane is exposed to low inlet pressure, through a high pressure discharge arc in which both sides of the vane are exposed to high discharge pressure, and through an outgoing seal arc, in which the leading edge side of the vane is exposed to low inlet pressure while the trailing edge side of the vane is still exposed to high discharge pressure. The unequal pressures in the seal arc areas can cause the vanes to chatter and lose contact with the continuous cam surface, resulting in damage to the vane tips and to the cam surface and reduced displacement capacity.

It is known to overcome these problems and to increase the displacement capacity of such vane pumps by venting the undervane areas of the vane slots to the high discharge pressurized fluid in the seal arc areas to balance the pressures acting on the undervane and overvane areas and maintain the vane tips in continuous tracking engagement with the cam surface. The additional advantage of such pumps is the substantial increase in displacement capacity obtained through the pumping of the undervane liquid supplementing the normal vane bucket discharge volumes.

In such known systems however, the undervane and overvane pressures are equal and act on the same size area, balancing the pressure load over the full 360° of the cam surface. Only the centrifugal load forces the vanes radially-outwardly against the cam surface.

It is more advantageous to provide a system in which loading pressure is regulated in the seal arc areas to provide a more positive tracking of the vane tips over the cam surface, rather than one dependent upon centrifugal forces.

SUMMARY OF THE INVENTION

The present invention provides a novel single acting variable displacement vane pump (VDVP) incorporating novel vanes and undervane venting which produce selective regulated pressure-loading of the vanes against the cam surface and more positive tracking in the incoming seal arc and the outgoing or discharge seal arc of the pump rather than uniform pressure balancing of the vanes throughout the 360° cam chamber.

The novel vanes incorporated into the present pumps preferably are sectional two-piece vane assemblies comprising an upper vane section which slidably supports a lower vane section and incorporates a fluid pressurizable cavity between said vane sections which, when pressurized, forces the vane sections in opposite radial directions, and which enables the vane sections to come together and integrate when the cavity is depressurized. The vane cavity is open to the fluid pressure on one side of the vanes while the undervane area of the vane slots, below the vanes, is open to the fluid pressure one the opposite side of the vanes. Thus, in the inlet seal arc area of the pump the vane cavity becomes pressurized to force the vane sections apart and force the upper vane section against the cam surface, and in the outlet or discharge seal arc area of the pump the vane cavity becomes depressurized and the undervane area of each vane slot becomes pressurized, to force the vane sections together and force the upper vane section against the cam surface. This regulates the positive loading pressure of the vanes in both of the seal arc areas to assure positive tracking of the vane tips in these seal arc areas.

THE DRAWINGS

DETAILED DESCRIPTION

Figure 1:
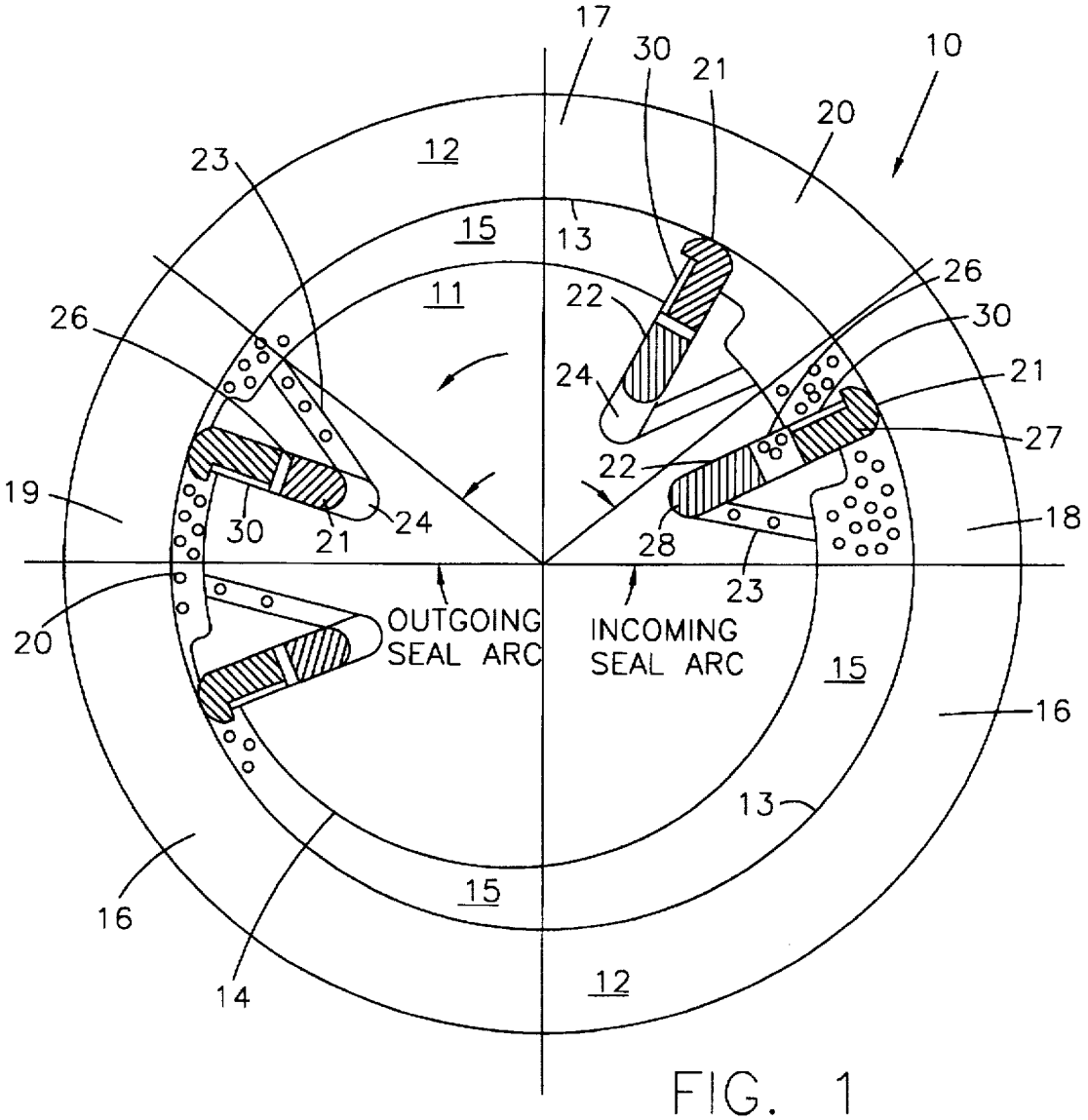
FIG. 1 is a cross-sectional view of representative areas of the cam section of a VDVP pump according to an embodiment of the present invention.
Figure 3:
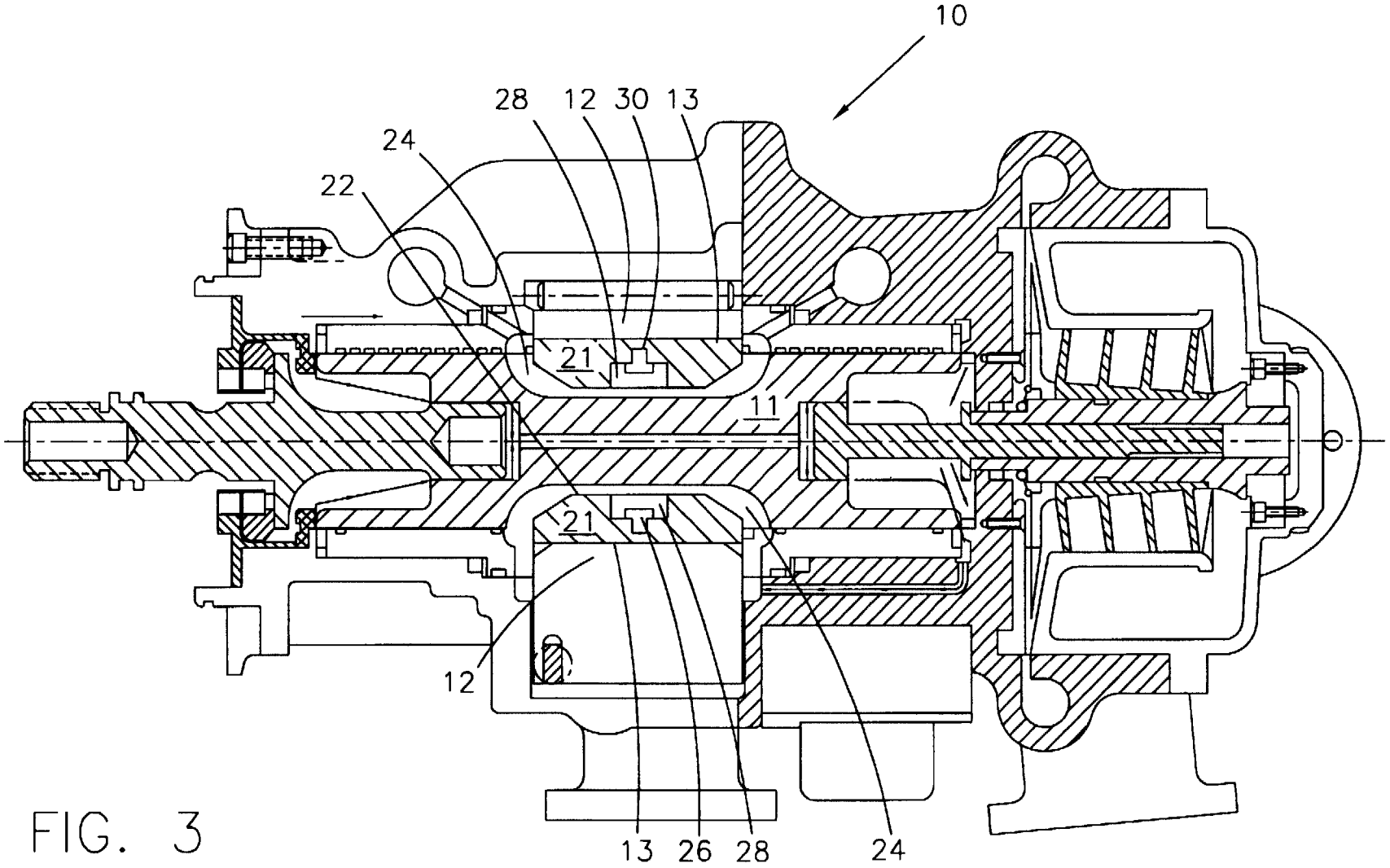
FIG. 3 is a schematic cross-sectional view of a fuel pump assembly according to one embodiment of the present invention.

The VDVP 10 of FIG. 1, illustrated as an assembly mounted to a main engine gearbox in FIG. 3, comprises a rotor assembly 11 rotatably supported within a pivotably adjustable cam member 12 having a smooth continuous circular cam surface 13 forming the inner circumferences thereof. The cam member 12 is supported for adjustment of its concentricity relative to the rotor assembly 11 in order to vary the liquid displacement capacity of the pump between zero, when the cam member 12 and the rotor assembly are co-axial, and maximum capacity, when the cam member is offset as far as possible. The annular space between the cam surface 13 and the outer surface 14 of the rotor assembly comprises the cam chamber 15, different arcuate areas of which are open to the supply and to the discharge of liquid, such as aircraft fuel, and different intermediate arcuate areas of which provide seals between the low pressure inlet arc area on one side thereof and the high pressure discharge arc area on the other side thereof.

In FIG. 1, the inlet arc area 16 of the cam chamber 15 is the lower hemispherical arc, which is open to the supply of liquid fuel under low pressure in conventional manner, and the outlet or discharge arc 17 of the cam chamber is the upper 110° arc, which is open to discharge ports for the discharge of pressurized liquid fuel to the desired destination. An inlet or incoming seal arc 18 separates the low inlet pressure arc 16 from the high discharge pressure arc 17, and an outgoing or discharge seal arc 19 separates the high discharge pressure arc 17 from the low inlet pressure arc 16 as the rotor 11 rotates counterclockwise on its journal ends within seal bearings.

The liquid pressure is increased from the inlet arc 16 to the discharge arc 17 by the sectioning of the cam chamber into bucket areas 20 between adjacent vanes 21 which are supported for radial movement within radial vane slots 22 in the rotor member 11 for continuous engagement of the vane tips with the cam surface 13. The cam bucket areas 20 expand in volume as they are rotated through the low pressure fluid-inlet arc 16 and become filled with the liquid fuel. As each vane 21 is rotated through the inlet seal arc 18 the bucket area 20 in advance thereof becomes reduced in volume and thereby pressurized while the trailing bucket area 20 is still exposed to the low pressure arc 16. The reverse effect occurs at the discharge seal arc area 19 in which the bucket area 20 trailing the vane 21 into seal arc 19 is contracted and under the high pressure of arc 17 whereas the leading bucket area 20, in advance of the vane 21 is expanding and open to the low pressure of the inlet arc 16.

These pressure differentials on different sides of conventional vanes can cause the vane tips to lose engagement with the cam surface or to chatter thereagainst, causing vane tip wear and cam surface scoring. However, the novel structure of the present rotor members 11 and the vanes 21 establishes and maintains a positive high pressure beneath the vanes in both the inlet seal arc 18 and the outgoing seal arc 19 to force the vanes 21 radially-outwardly against the cam surface 13 and avoid any retraction of the vanes in response to leakage of high pressure liquid past the vane tips.

In the embodiment of FIG. 1, member 11 is provided with eight radial vane slots 22, selected ones of which are illustrated, and a vent or passage 23 which opens through the rotor surface 14 between the undervane area 24 of each vane slot 22 and the cam bucket area 20 trailing said vane slot 22, to open each undervane area 24 to the pressure existing in the cam bucket areas 20 trailing its vane slot 22. Thus, in the outgoing seal arc area 19, the high pressure in the trailing bucket area 20 is conveyed to the undervane area 24 through the passage 23 to force the vane 21 radially-outwardly against the cam surface 13, as illustrated.

In the inlet seal arc area 18, a different means must be used to produce positive outward pressure to force the vanes against the cam surface. Thus the vanes 21 are designed as 2-piece vanes 25 having a pressurizable cavity or compartment 26 therebetween which, when exposed to the liquid under high pressure, causes the upper vane portion 27 to be forced radially-outwardly with its tip against the cam surface 13 and causes the lower vane portion 28 to be forced radially-downwardly against the bottom of the vane slot. Since the undervane area 24 of the vane slot 22 in the incoming seal arc area 18 is open to low inlet pressure, through the passage 23, the downward movement of the lower vane section is not resisted.

Pressurization of each vane compartment 26 is accomplished by opening said compartment to the pressure existing in the cam bucket area 20 in advance of the upper cam section 27 by providing the leading face 29 of the vane section 27 with a recess 30 which opens above the outer surface of the rotor member 11 and opens down into the cavity 26 to provide open communication between each vane cavity 26 and the pressure existing in the bucket area 20 ahead of each said vane 25. Thus, in the inlet seal arc area 18, cavity 26 becomes pressurized to force the upper vane section 27 against the cam surface, and in the discharge seal arc 19 the recess 30 opens to the low pressure liquid of the leading vane bucket area 20 to depressurize the cavity 26 while the undervane area 24 is open to the high pressure trailing vane bucket area 20, through the passage 23, to create a positive pressure which forces the lower vane section 28 against the upper vane section 27 and against the cam surface 13. A positive undervane pressure is important in both seal arc areas 18 and 19 to prevent the high pressure liquid on one side of the vane from escaping between the vane tip and the cam surface into the lower pressure bucket area on the other side of the vane resulting in chattering, wear and reduced displacement efficiency.

Figure 2:
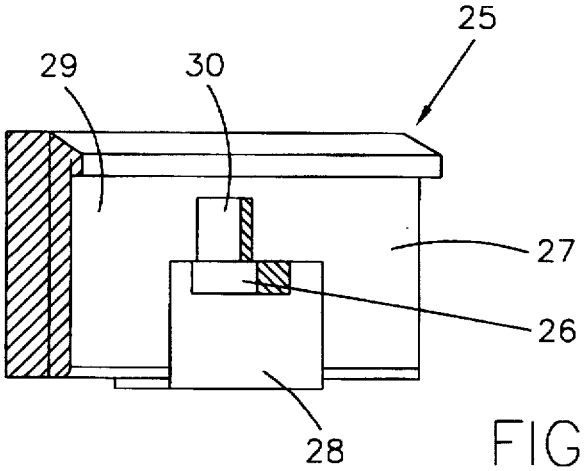
FIG. 2 is an enlarged perspective view of a vane assembly according to a preferred embodiment of the present invention.

It will be apparent to those skilled in the art that the specific vane design of FIG. 2 is not critical, and that a wide variety of other designs and configurations can be used to produce the novel results accomplished by the present invention. The critical requirements involve the use of vane elements having an upper vane section, a lower vane section and a pressurizable cavity 26 or space therebetween which, when pressurized, causes the vane sections to be forced radially within the vane slot 22 in different directions. The leading face of each upper vane section must have a recess 30 or spaces which is open between the pressurizable cavity 26 and the forward vane bucket area 20 at all times throughout the 360° revolution of the rotor member 11 so that each vane cavity 26 is always brought to the same pressure as that of the vane bucket area 20 in advance of the vane. Equally important, the base 24 of the vane slot 22 must always be open to the same pressure as that of the vane bucket area 20 behind the vane so that in the outgoing seal arc area 19, where the liquid pressure in the bucket area 20 behind each vane is higher than the liquid pressure in the bucket area 20 ahead of each vane, the higher pressure is open, through passage 23, to the undervane areas 24 to apply a positive undervane pressure to force each vane tip against the cam surface 13 in the seal arc area 19 to prevent escape of the liquid pressure therebetween.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A variable displacement vane pump comprising:

(a) a cylindrical rotor member having journal ends and a central vane section comprising a plurality of radial vane slots uniformly spaced around the central circumference thereof, said vane slots being elongate in the axial direction and each having a vane supporting portion;

(b) a plurality of vane elements, each comprising an assembly of an upper segment and a lower segment having a cavity therebetween, said vane segments being united by slide means which seal said cavity against pressures existing in other areas of the vane slot and which enable said segments to be drawn together or forced apart within the vane slot in response to low pressure or high pressure within said cavity, each said assembly being slidably-engaged within the vane-supporting portion of a said vane slot for radial movement therewithin;

(c) a unitary cam member having opposed faces and a bore therethrough forming a cam chamber having a continuous interior cam surface, the central vane section of said rotor member being supported axially and non-concentrically within said cam chamber so that the outer tip surfaces of the upper segments of all of the vane elements make contact with said continuous interior cam surface to form cam bucket areas between adjacent vanes, the volumes and pressures of which bucket areas change during operation of the pump, during rotation of said rotor member between a low pressure fuel inlet arc segment, an inlet seal arc segment, a high pressure fuel outlet arc segment and an outlet seal arc segment of said cam chamber;

(d) first port means between one side of each vane slot and the upper segment of the vane element therewithin to expose the cavity between the upper and lower vane segments to the pressurized liquid in the bucket area on said one side of the upper vane segment, and (e) second port means through said rotor member at the other side of each vane slot, communicating between the bottom of said vane slot and the cam bucket area on said other side of the vane slot, whereby during rotation of the rotor member through the seal arc segments of the cam chamber, the higher pressurized liquid in the bucket area on one side of each vane is admitted through the port means at said side to provide a positive pressure urging each vane tip against the cam surface during rotation through said seal arc segments.

2. A vane pump according to claim 1 in which said first port means comprises a recess in the leading face of each upper vane segment, opening the cam bucket area ahead of said upper vane segment to the said cavity.

3. A vane pump according to claim 1 in which said second port means comprises a bore through the surface of the rotor member in the bucket area at the trailing side of each vane element to the bottom of the vane slot containing said vane element, opening the cam bucket area behind said lower vane segment to the area of the vane slot below said lower vane segment.

4. A vane pump according to claim 1 in which each said upper vane segment comprises an elongate upper vane segment having an intermediate cut-out area forming a said cavity, which is open through the bottom wall of said upper vane segment, and said lower vane segment comprises a segment which is slidable within the cut-out area of the upper vane segment, towards or away from the upper vane segment in response to depressurization or pressurization, respectively, of said cavity.

* * * * *